US006962489B2

(12) United States Patent
Marielle et al.

(10) Patent No.: US 6,962,489 B2
(45) Date of Patent: Nov. 8, 2005

(54) MOINEAU PUMPING DEVICE HAVING A BALL COUPLING

(75) Inventors: Jean-Pierre Marielle, Le Mesnil Esnard (FR); Jean-Paul Wautelet, Villepinte (FR)

(73) Assignee: PCM Pompes, (FR)

( * ) Notice: Subject to any disclaimer, the term of this patent is extended or adjusted under 35 U.S.C. 154(b) by 130 days.

(21) Appl. No.: 10/288,588

(22) Filed: Nov. 6, 2002

(65) Prior Publication Data

US 2004/0131491 A1 Jul. 8, 2004

(30) Foreign Application Priority Data

Nov. 7, 2001 (FR) ..... 01 14391

(51) Int. Cl.[7] ..... F01C 1/10

(52) U.S. Cl. ..... 418/48; 418/182; 464/106; 464/139; 464/140; 464/147

(58) Field of Search ..... 418/48, 182; 464/106, 464/139, 140, 147

(56) References Cited

U.S. PATENT DOCUMENTS 1,551,323 A * 8/1925 Offrdahl ..... 464/139
2,140,295 A * 12/1938 Mallard ..... 464/152
3,802,803 A * 4/1974 Bogdanov et al. ..... 418/48
4,549,872 A 10/1985 Kumpar
5,267,905 A * 12/1993 Wenzel et al. ..... 464/140
5,688,114 A * 11/1997 Millington et al. ..... 418/48

FOREIGN PATENT DOCUMENTS

DE 32 05 222 8/1983
DE 195 30 978 2/1997

* cited by examiner

*Primary Examiner*—Theresa Trieu
(74) *Attorney, Agent, or Firm*—Stites & Harbison PLLC; Marvin Petry

(57) ABSTRACT

A pumping device is provided which comprises a Moineau pump with a helical rotor inside a helical cavity of a stator, driver means, and a drive connecting rod coupled by a respective coupling to a driving shaft of the driver and to one end of the rotor. Each coupling comprises a spherical head secured to the connecting rod and housed in a cavity that is cylindrical of revolution with the same diameter as and secured coaxially to the end of the rotor of the driving shaft; and a ball housed partly in a cup of the spherical head with its axis perpendicular to the axis of the connecting rod and partly in a lateral recess of the cavity.

6 Claims, 3 Drawing Sheets

MOINEAU PUMPING DEVICE HAVING A BALL COUPLING

FIELD OF THE INVENTION

The present invention relates to improvements made to pumping devices comprising a pump with progressive cavities or Moineau pumps with a helical rotor inside a helical cavity of a stator, drive means with a driving shaft roughly coaxial with the cavity of the stator, and a drive connecting rod which is inserted between the driving shaft of the drive means and one end of the rotor to both of which it is coupled by respective coupling means arranged so that the said connecting rod can follow the double rotational movement of the rotor (rotation of the rotor about its own axis, and rotation of the axis of the rotor about the axis of the cavity of the stator).

DESCRIPTION OF THE PRIOR ART

Bearing in mind the double rotational movement of the rotor, on the one hand, and the absence of coaxiality of the rotor and the driving shaft of the drive means, on the other, the connecting rod occupies an inclined position and, during its rotational movement, moves in a conical envelope. This means that the connecting rod has to be coupled to the driving shaft of the drive means and to the end of the rotor in such a way that it can occupy a position that is inclined with respect to the respective axes, which are parallel but not coaxial, of these items while at the same time assuming its function of transmitting torque.

In order to meet this requirement, it is common practice for the connecting rod to be produced in the form of a metal bar and for appropriate couplings to be provided between its two ends and, respectively, the driving shaft of the drive means and the end of the rotor. Numerous types of coupling are known in this context. Since a conventional cardan coupling does not allow the connecting rod sufficient inclination (or alternatively requires a connecting rod of significant length), various embodiments of coupling derived from the cardan coupling, but allowing greater inclinations, and therefore allowing shorter connecting rods, are known.

However, these known couplings have the disadvantage of being made of a great many parts, which increases their cost of manufacture and their servicing costs.

Furthermore, some of these parts, which rotate with respect to each other, are assembled using rotation or pivot pins. Now, the connecting rod has to be able to withstand compressive axial forces generated by the reactions of the pump rotor during operation: the aforementioned pins have in particular to be able to withstand these forces without breaking, and this leads to them being oversized.

SUMMARY OF THE INVENTION

It is essentially an object of the invention to provide an improved coupling arrangement able to allow the connecting rod a great deal of inclination (and therefore to lead to a shortening of this connecting rod) while at the same time comprising only a very small number of constituent parts which do not call upon any hinge pins and which is therefore able without damage to withstand high axial reaction forces, the constituent parts being simple and inexpensive.

To these ends, a pumping device as mentioned in the preamble is characterized, being arranged according to the invention, in that each of the said coupling means comprises

- a spherical head secured to the connecting rod at the rotor end or the driving shaft end, respectively,
- a cavity that is cylindrical of revolution with the same diameter as said spherical head so as to accommodate the latter and secured coaxially to the rotor end or the driving shaft end of the connecting rod, respectively, and
- a ball housed, in part, in a cup in the shape of a spherical cap of a complementary shape made in the spherical head which is arranged in such a way that its axis is roughly perpendicular to the axis of the connecting rod at the rotor or at the driving shaft end respectively and, in part, in a lateral recess of complementary dimensions made in the cavity that is cylindrical of revolution, whereby the ball forms an offset rotary articulation compatible with the movement of the double rotation inherent to the Moineau pump and able to allow the connecting rod to be inclined appreciably with respect to the end of the rotor or of the driving shaft, respectively, as the driving shaft that drives the rotor rotates.

In a preferred embodiment, the spherical head is secured to the connecting rod and the cavity that is cylindrical of revolution is provided on the end of the rotor and on the drive shaft, respectively. In a simple embodiment, the fact that such spherical heads are commonly available commercially is put to good use: it is then possible to make the connecting rod comprise a rigid bar forming the shank of the rod, to the respective ends of which two spherical heads are secured (for example by welding).

In an embodiment of simple design, the cavity that is cylindrical of revolution is defined in a hollow sleeve secured to the end of the rotor or to the end of the driving shaft and said lateral recess provided in said cavity is defined by a hole passing radially through the lateral wall of said sleeve and by a ring attached to the outer wall of said sleeve to externally close said hole. In particular, said outer ring is fixed to the sleeve by at least one radial screw.

By virtue of the arrangements which have just been listed, a coupling is formed in which the ball assumes the dual function of rotary articulation and member for transmitting axial forces: thus, there is no longer a pivot pin. What is more, the number of component parts is reduced and they are simple to assemble without the need to carry out complex machining. Finally, according to the intended objective, the connecting rod is able to be inclined appreciably, which means that it is possible to anticipate appreciable shortening of the connecting rod, making for a more compact pumping device.

Even more pronounced inclinations of the connecting rod can be obtained by making the annular part of the inner wall of the sleeve situated between said lateral recess and the end of the sleeve be of frustoconical shape.

BRIEF DESCRIPTION OF THE DRAWINGS

The invention will be better understood from reading the detailed description which follows of certain preferred embodiments which are given solely by way of entirely non-limiting examples. In this description, reference is made to the appended drawings, in which.

DETAILED DESCRIPTION OF THE DRAWINGS

Figure 1:
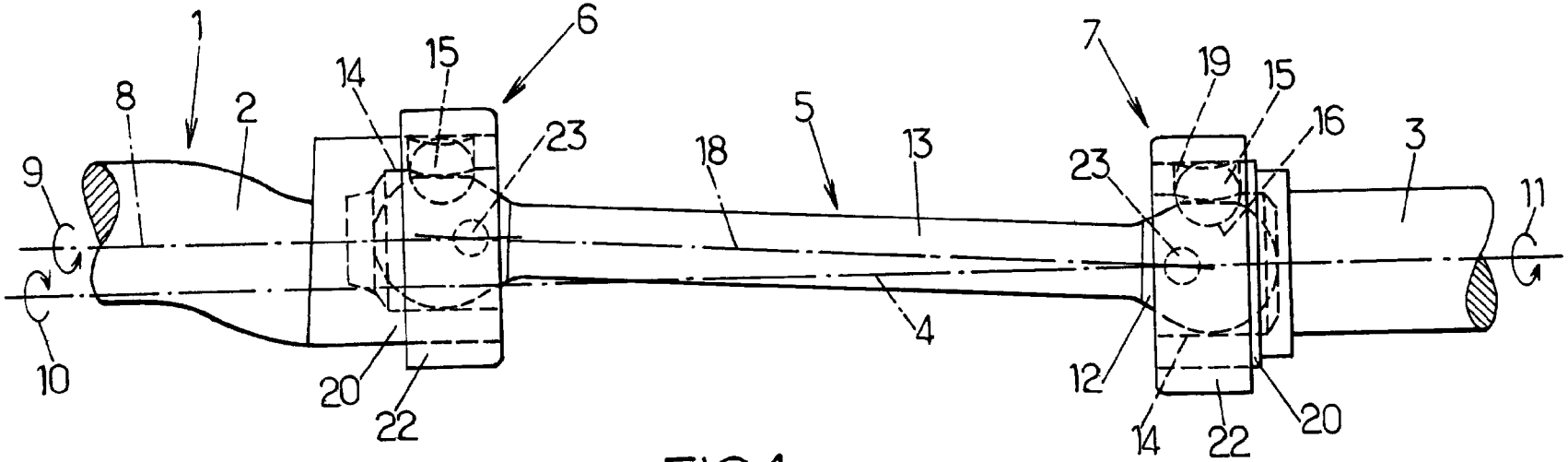
FIG. 1 is a side view of the part of a progressive cavities pump pumping device at which the present invention is more specifically aimed.

Referring first of all to FIG. 1, the pumping device to which the invention relates comprises

- a progressive cavities pump or Moineau pump 1 with a helical rotor 2 which is inside a helical cavity of a stator (not shown);
- drive means (not shown) having an output shaft or driving shaft 3 which is coaxial (axis 4) with the helical cavity of the stator; and
- a drive connecting rod 5 which is inserted between an end of the rotor 2 and the driving shaft 3 to both of which is coupled a respective coupling means 6, 7.

It is known that, in a Moineau pump, the rotor 2 is given a dual rotational movement, namely a rotation of the rotor 2 about its own axis 8 (arrow 9) and a rotation in the opposite direction of its axis 8 about the axis 4 of the stator cavity (arrow 10). The coupling means 6, 7 are therefore arranged in such a way that the connecting rod 5 can follow the double rotation of the end of the rotor while the driving shaft 3 rotates about the axis 4 (arrow 11).

Figure 3:
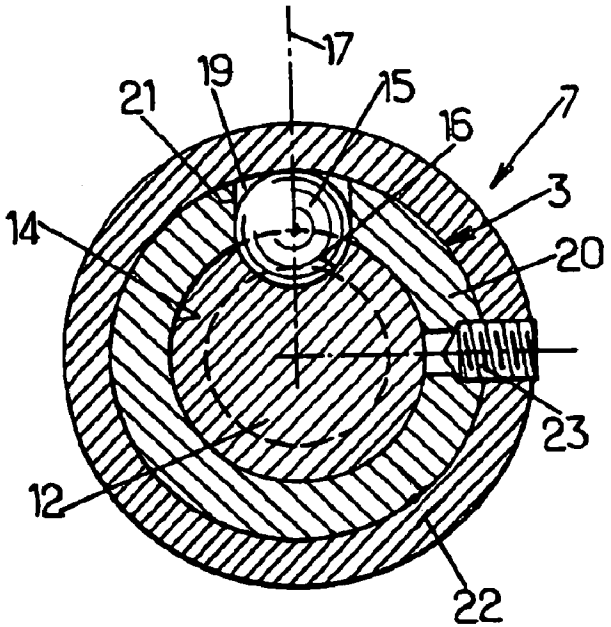
FIG. 3 is a view in cross section on III-III of FIG. 2.
Figure 2:
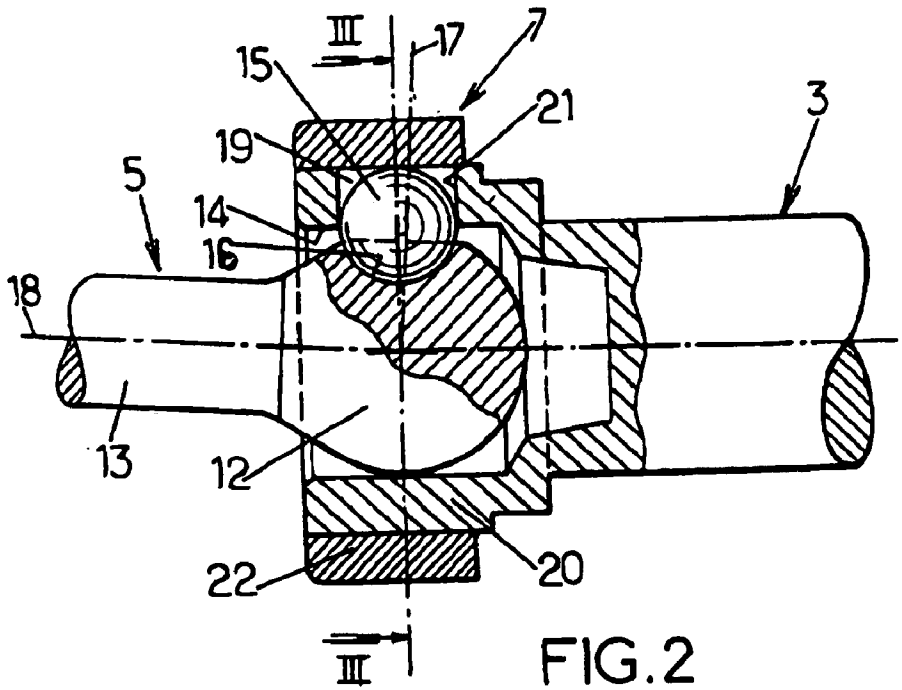
FIG. 2 is a sectioned side view, on a larger scale, of a coupling visible in FIG. 1.

The means 6 of coupling between the connecting rod 5 and the end of the rotor 2 and the means 7 of coupling between the connecting rod and the driving shaft 3 are identical and are arranged with the same radial orientation with respect to the connecting rod, as visible in FIG. 1. FIGS. 2 and 3 depict, on a larger scale, by way of example, the means 7 of coupling between the connecting rod 5 and the driving shaft 3.

The coupling means 7 comprise:

- a spherical head 12 secured to the corresponding end of the connecting rod shank 13 and arranged coaxially therewith;
- a cavity 14 that is cylindrical of revolution with the same diameter as the spherical head 12 to accommodate the latter, this cavity 14 being secured coaxially to the end of the driving shaft 3; and
- a ball 15 housed, in part, in a cup 16 in the shape of a spherical cap of complementary shape hollowed into the spherical head 12 so that its axis 17 is roughly perpendicular to the axis 18 of the connecting rod 13 and, in part, in a lateral recess 19 of complementary size hollowed into the wall defining the cylindrical cavity 14.

By virtue of this arrangement, the ball 15 forms an offset rotary articulation compatible with the movement of the dual rotation inherent to the Moineau pump (rotational movement of the rotor about its own axis and rotational movement of the axis of the rotor in the opposite direction about the axis of the stator) and able to allow the connecting rod 5 to incline appreciably with respect to the end of the rotor 2 or of the driving shaft 3, respectively as the driving shaft driving the rotor rotates.

Advantageously, because of the low cost that results from such a structure, the connecting rod 5 may consist of an assembly of three parts, namely a rigid bar, particularly made of metal (for example steel) forming the aforesaid connecting rod shank 13 (this may, in particular, be a length of round steel bar stock of appropriate diameter, cut to the desired length) and two metal spheres (particularly made of steel) which are attached and secured to the frontal ends of the rigid bar. Such spheres are available commercially; all that is required is for a flap to be formed so that they can be secured onto the frontal end of the bar by any appropriate means, for example preferably by welding.

In the same way, the cylindrical cavity 14 can be machined directly into the widened end of the rotor and of the driving shaft, this widened end then forming a hollow sleeve 20 integral with the rotor or the driving shaft (as is the case illustrated in FIG. 2).

However, here again, the hollow sleeve 20 could be machined in the form of an independent part subsequently attached and secured (particularly welded) to the frontal end of the rotor or of the driving shaft.

Whatever the solution adopted, the recess 19 made laterally in the cavity 14 is, in a structurally simple way, defined by a through-hole 21 pierced through the lateral wall of the sleeve 20. Once the spherical head 12 has been introduced into the cavity 14 of the sleeve 20 with the cup 16 arranged facing the through-hole 21 and once the ball 15 is introduced into the hole 21 from the outside, a ring 22 is attached to the sleeve 20, externally thereto, so as to close off the hole 21 and retain the ball. This ring could be screwed onto the threaded external surface of the sleeve. In the example illustrated in FIGS. 1 and 3, however, fixing is obtained using one or more radial binding screws 23 engaged in aligned respective balls of the ring 22 and of the wall of the sleeve 20 (see FIG. 3).

The dimensions of the recess 19 have to be such that the ball 15 is held therein with freedom to rotate, but without any substantial clearance other than the functional clearance.

By virtue of this arrangement, in each of the coupling means 6, 7, the ball 15 assumes the dual function, on the one hand, of pivot or articulation for rotation of the connecting rod 5 with respect to the driving shaft 3 or to the end of the rotor 2, this being in all directions, and, on the other hand, as member for transmitting rotary forces between the driving shaft 3 and the connecting rod 5 and between the connecting rod 5 and the rotor 2 and as a member for transmitting axial reaction forces between the rotor 2 and the connecting rod 5 and between the connecting rod 5 and the driving shaft 3. It is a simple structure, with few component parts, particularly one free of pivot pins, of very good mechanical robustness, and of modest cost.

What is more, and this is an important advantage that the invention seeks to obtain, the connecting rod 5 can be inclined very much with respect to the driving shaft 3 and with respect to the end of the rotor 2, without there being a hard point in the rotation. By way of example, it is possible to achieve connecting rod inclinations of the order of 5° with perfectly satisfactory operation.

What is more, as a very result of these high inclinations made possible by the structure according to the invention, it becomes conceivable for the connecting rod 5 to be shortened correspondingly, that is to say to use a shorter connecting rod shank 13, and this leads to a pumping device which overall is more compact, thereby satisfying user desires. In a typical example, for a connecting rod inclination of the order of 5°, the connecting rod can have a length of the order of 135 mm (whereas conventionally, a maximum connecting rod inclination of the order 1 to 2° leads to a connecting rod length of the order of 675 mm for the same operating conditions).

Figure 4:
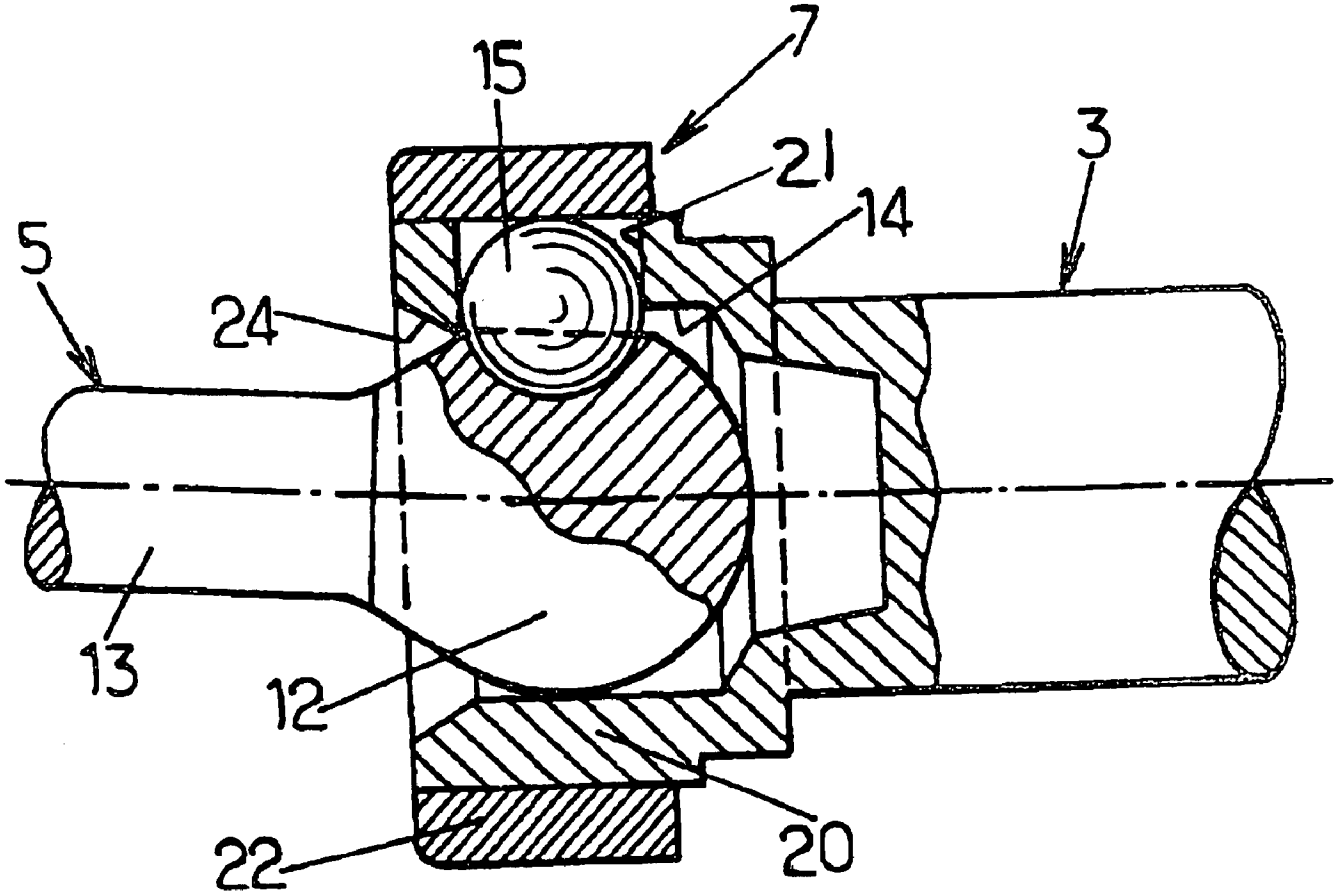
FIG. 4 is an alternative form of embodiment of the coupling of FIG. 2.

It is also possible to increase the inclination of the connecting rod 5 with respect to the driving shaft 3 and with respect to the end of the rotor 2 significantly by providing a clearer entry to the hollow sleeve 20. As illustrated in FIG. 4, the annular portion of the cavity 14 which lies between the frontal face of the sleeve 20 and the through-hole 21 can be arranged in the form of a frustoconical region 24 which may have a cone angle that may be as high as about 10°. Thus, the inclination of the connecting rod 5 can be increased appreciably until it now reaches a value of the order of 10°.

It will also be noted that the structure adopted for the coupling means leads to very simple securing and detachment of each end of the connecting rod with respect to the respective member to which it is coupled. For example, as regards the coupling 6 between the connecting rod 5 and the rotor 2, all that is required is for ring 22 to be removed and taken axially out of the rotor, supporting the latter, then for the rotor to be raised, keeping it parallel to its initial position, and this gradually increases the relative inclination of the rotor and of the connecting rod until the ball 15 can disengage from the recess 19; after that, the rotor 1 and the connecting rod 5 may be disengaged from one another.

From the foregoing explanations it will be understood that, for both of the coupling means 6 and 7, the positions of the spherical head 12 with its ball 15 and of the sleeve 20 are relative positions and that the members in question may be reversed, that is to say that the sleeve 20 with its ring 22 may be mounted at the end of the connecting rod shank 13 and that the spherical head 12 with its ball 15 may be mounted at the end of the driving shaft 3 and the end of the rotor 2, respectively.

What is claimed is:

1. A pumping device comprising a pump with progressive cavities or Moineau pump with a helical rotor inside a helical cavity of a stator, drive means with a driving shaft roughly coaxial with the cavity of the stator, and a drive connecting rod which is inserted between the driving shaft of the drive means and one end of the rotor to both of which it is coupled by respective coupling means arranged so that said connecting rod follows rotation of the rotor about its own axis, and rotation of the axis of the rotor about the axis of the cavity of the stator, wherein each of said coupling means comprises a spherical head secured to the connecting rod at the rotor end or the driving shaft end, respectively, a cavity that is cylindrical of revolution with the same diameter as said spherical head so as to accommodate the latter and secured coaxially to the rotor end or the driving shaft end of the connecting rod, respectively, and a ball housed, in part, in a cup in the shape of a spherical cap of a complementary shape made in the spherical head which is arranged in such a way that its axis is roughly perpendicular to the axis of the connecting rod at the rotor or at the driving shaft end respectively and, in part, in a lateral recess of complementary dimensions made in the cavity that is cylindrical of revolution, whereby the ball forms an offset rotary articulation of said spherical head about a center of said ball compatible with the movement of the double rotation inherent to the Moineau pump and allowed the connecting rod to be inclined appreciably with respect to the end of the rotor or of the driving shaft, respectively, as the driving shaft that drives the rotor rotates.

2. The pumping device according to claim 1, wherein the spherical head is secured to said connecting rod, and wherein the cavity that is cylindrical of revolution is provided on the end of the rotor and on the drive shaft, respectively.

3. The pumping device according to claim 2, wherein said connecting rod comprises a rigid bar forming the shank of the rod, to the respective ends of which two spherical heads are secured.

4. The pumping device according to claim 1, wherein said cavity that is cylindrical of revolution is defined in a hollow sleeve secured to the end of the rotor or to the end of the driving shaft, and wherein said lateral recess provided in said cavity is defined by a hole passing radially through the lateral wall of said sleeve and by a ring attached to the outer wall of said sleeve to externally close said hole.

5. The pumping device according to claim 4, wherein said outer ring is fixed to the sleeve by at least one radial screw.

6. The pumping device according to claim 1, wherein the annular part of the inner wall of the sleeve situated between said lateral recess and the end of the sleeve is of frustoconical shape.

* * * * *